United States Patent [19]

Clare et al.

[11] Patent Number: 4,826,504

[45] Date of Patent: May 2, 1989

[54] CALCIUM/SODIUM ALIGINATE DYE PRINTING PASTE

[75] Inventors: Kenneth Clare, Sutton; Erle Hopkinson, Horley, both of England

[73] Assignee: Kelco/AIL International Limited, London, England

[21] Appl. No.: 51,445

[22] Filed: May 18, 1987

Related U.S. Application Data

[63] Continuation of Ser. No. 888,542, Jul. 21, 1986, abandoned, which is a continuation of Ser. No. 650,598, Oct. 15, 1984, abandoned.

[30] Foreign Application Priority Data

Oct. 17, 1983 [GB] United Kingdom ..... 8327743

[51] Int. Cl.[4] ..... C09B 67/38; C09D 11/14; D06P 1/48; D06M 15/13

[52] U.S. Cl. ..... 8/561; 8/557; 8/618; 8/922

[58] Field of Search ..... 8/557, 561, 618

[56] References Cited

U.S. PATENT DOCUMENTS

| | | | |
|---|---|---|---|
| 3,282,717 | 11/1966 | Kelley | 106/208 |
| 3,349,079 | 10/1967 | Freedman | 536/3 |
| 4,222,740 | 9/1980 | Bohrn | 8/448 |
| 4,519,803 | 5/1985 | Clare et al. | 8/445 |
| 4,693,728 | 9/1987 | Clare et al. | 8/561 |
| 4,713,084 | 12/1987 | Bohrn et al. | 8/561 |

OTHER PUBLICATIONS

W. H. McNeely and D. J. Pettit in Whistler's "Industrial Gums" (Academic Press, 1973), Second Edition, pp. 54–57, 63 and 67–75.

*Primary Examiner*—A. Lionel Clingman
*Attorney, Agent, or Firm*—Gabriel Lopez; Hesna J. Pfeiffer

[57] ABSTRACT

In the printing of dyes onto substrates, the use of a mixed, cross-linked calcium/sodium alginate to thicken the dye solution effectively reduces dye usage.

7 Claims, No Drawings

CALCIUM/SODIUM ALIGINATE DYE PRINTING PASTE

This is a continuation of application Ser. No. 888,542 filed July 21, 1986, which is a continuation of U.S. Ser. No. 660,598 filed Oct. 15, 1984 now abandoned.

The use of alginates in textile print pastes is well known. For example, GB Pat. No. 021,609 teaches a thickener containing sec-hydroxyalkyl alginate or an amine salt of alginic acid, or sec-hydroxyalkyl alginate mixed with derivatives of polymers of acrylic acid or maleic anhydride/ethylene copolymers.

It is also well known that alginates react with bivalent metal cations, most notably calcium, to form gels. The combination of algins and calcium salts has been disclosed in U.S. Pat. No. 4,222,740 as a means of forming dye resist areas on textiles. As taught therein, gelled regions are formed by separately applying a gelable (alginate) composition and a gelling (calcium) agent composition to a textile and then over-dyeing the material, the gelled regions serving as dye resist areas. In another embodiment, lateral ink spread is taught to be reduced by incorporating a dye into either the gelable composition, the gelling compositions, or both. The amount of gelling agent taught must be sufficient to gel the alginate composition. Specifically, a 5% (by weight) composition is recommended, although 1–10% is taught to work. The amount of alginate is taught to be from 0.5 to 5% by weight, preferably 1% to 2.5%. U.K. Pat. No. 8300635 (DE 3300705 A1) teaches that when very low levels of a gelling agent are used to pretreat a substrate followed by printing with an alginate-containing print paste, the dye usage for equal color yield is reduced, accompanied by improved print definition.

It has now been found that the use of a mixed divalent/monovalent (such as calcium/sodium) salt of alginic acid in the print paste effects a reduction in dye usage for equivalent color yield when compared to a print paste using sodium alginate or other conventional thickener. The reduction in dye usage is accomplished without the necessity of pretreating the substrate. Thus, the use of the mixed calcium/sodium alginate advantageously eliminates one of the process steps required in U.S. Pat. Nos. 4,222,740 and U.K. Pat. No. 8300635 while producing a savings in dye usage.

By alginate is meant the salts of alginic acid. Alginates are found in all species of Phaeophyceae, brown algae. A mixed calcium/sodium alginate is used in the practice of this invention. The specific amount and type of alginate used in any particular application will, of course, be dependent on the other materials in the print paste, e.g., oxidizing agents, buffers, etc. These can be determined by the individual practitioner depending on his particular formulation. However, usage levels in the range 1 to 5% by weight are within the scope of this invention; preferably 1 to 2.5%. The viscosity of the print pastes should be 5,000 to 20,000 cP (RVT or RVF, Brookfield Viscometer at 20 rpm, spindle 6, 20° C.) immediately before printing. Optionally, thickening agents such as guar, carboxymethyl guar, de-polymerized guar, locust bean gum, CMC, suitable synthetic polymers, cellulose derivatives such as sodiumcarboxymethyl cellulose, and starch derivatives or combinations of said agents may be included to provide some of the viscosity.

The calcium/sodium alginate solution of this invention is shear sensitive; i.e., the high viscosity print paste thins down as it is sheared through a printing screen but recovers quickly to control penetration into the cloth. The calcium level of this mixed salt is critical and lies between 1.6 and 6% wt. $Ca^{++}$/wt. Na alginate, preferably between 2.5 and 5%. Generally, the calcium/sodium alginate material is prepared from alginic acid at 30–40% dry solids by adding sufficient calcium carbonate to give a calcium level in the range of 1.6 to 6% wt. $Ca^{++}$/wt. Na alginate. The ingredients are mixed for 15–60 minutes at ambient temperature till the reaction is complete and then sodium carbonate is added until the pH of the product is 5.5 to 7.5. The resultant product is then milled and dried. It is preferred to use a high viscosity alginate, i.e., such as is extracted from seaweeds which contain high mannuronic acid polymer, e.g. an Ascophyllum Nodosum/Durvillea Potatorum mixture. The alginate is precipitated as the calcium salt and pressed to remove excess calcium chloride solution. The calcium/sodium mixed salt can then be prepared in a number of different ways, e.g.:

(i) Partial leaching of calcium alginate to give a mixed calcium alginate/alginic acid product. The alginic acid portion is then neutralized with sodium carbonate to give the mixed calcium/sodium alginate; or (ii) The calcium alginate can be fully leached to yield alginic acid which can then be neutralized with calcium carbonate and sodium carbonate to yield the mixed salt of alginic acid.

Although this is the preferred method, other techniques for making the mixed salt are envisioned. For example, one can use calcium alginate or sodium alginate as starting materials and prepare the mixed salt therefrom. Further, the inventions is not limited to the calcium/sodium mixed salt. A mixed salt having the same rheological properties can be prepared using other divalent and monovalent cations such as barium and potassium. Alginic acid is commercially available and can be used as the starting material. Alginic acid which on 100% conversion to sodium alginate yields a viscosity of 50–2000 cP for a 1.0% solution measured on as RVT/RVF Brookfield viscometer at 20° C. is used to make the mixed salt of this invention. Alginic acid which on conversion to sodium alginate yields a 1% viscosity of 600–800 cP (RVT/RVF Brookfield Viscometer, 20 rpm, 20° C., spindle 3) is preferred.

The print pastes of this invention are those prepared using pigments or dyes such as disperse dyes, reactive dyes, combinations of disperse and reactive dyes, and acid dyes, i.e., all anionic or non-ionic dyes but not cationic dyes. Reactive dyes are difficult to use because fixation, as with 1.5% sodium carbonate, is deleterious to the $Ca^{++}/Na^{+}$ ratio in the alginate. For brevity's sake, as used herein, the term "dye" is intended to also include "pigment". The invention is most effective with disperse dyes. In addition to the alginate and dye, these print pastes comprise a variety of well known compounds such as buffers, oxidizing agents, etc. The preparation of such pastes is known in the art.

The substrates to be treated include, for example, polyesters, cellulosics, cottons, blends of these such as polyester/cottons, nylons, and polyamides. The substrates can be any material which can be printed with the appropriate dyes.

In the process of this invention the print paste composition can be applied by any conventional printing or dye method such as flat or rotary screen printing, block or raised relief printing, jet printing, stencil printing, engraved cylinder printing, Tak dying, Kuster dying, dip squeeze application, or hand application.

When a substrate is treated according to this invention, it is observed that the print paste pick-up is 25% less when compared to pastes using conventional thickeners. The dye actually consumed can be reduced by up to 15–25% typically but taking into account shade strength and different dye colors, the range of dye reductions falls within 5–40%.

Following application of the print paste the substrate is treated as necessary to fix any dyes, then washed, dried and otherwise treated by conventional methods to produce the desired end product.

The following examples, which are intended to be illustrative and not limiting, further describe the invention. In these examples, evaluation of the results was done by visual and instrumental observation of the completely processed substrate. Percentages are by weight unless otherwise stated.

EXAMPLE 1

Polyester knitted fabric was printed wtih two print pastes constituted as follows:

| | Test Recipe (%) | Conventional Recipe (%) |
|---|---|---|
| Palanil Brilliant Blue P-BGF Liquid (non-ionic disperse dye) | 4.0 | 4.8 |
| Mono-Sodium Orthophosphate | 0.1 | 0.1 |
| Silcolapse 5006 (anti-foam agent based on Silicon Fluid Emulsion) | 0.05 | 0.05 |
| Prisulon SPE-K (thickener based on guar/starch derivatives) | — | 3.75 |
| Calcium/Sodium alginate (derived from high viscosity alginic acid, Ca = 3.0%) | 1.75 | — |
| Water | 94.1 | 91.3 |
| | 100.0 | 100.0 |

The dye was then fixed on the printed material by HT stream at 175° C. for 7 minutes followed by a normal wash procedure, then a conventional reduction clear, soap and rinse. The prints showed equal color intensity although 20% less dye was used in the example.

EXAMPLE 2

Polyester knitted fabric was printed with two print pastes constituted as follows:

| | Test Recipe (%) | Conventional Recipe (%) |
|---|---|---|
| Dispersol Rubine C-B Liquid (anionic disperse dye) | 4.0 | 4.8 |
| Mono-Sodium Orthophosphate | 0.1 | 0.1 |
| Matexil PAL (sodium-in-nitro-benzine sulphonate) | 1.0 | 1.0 |
| Manutex RS ® (high viscosity sodium alginate with 0.6% $Ca^{++}$ on alginate) | — | 2.25 |
| Calcium/Sodium alginate (derived from high viscosity alginic acid, Ca = 3.0%) | 1.75 | — |
| Calgon, sodium hexa-m-phosphate | — | 0.55 |
| Water | 93.15 | 91.3 |
| | 100.0 | 100.0 |

® Manutex is a trademark of Kelco/AIL International Ltd.

The dye was then fixed and washed for 7 minutes followed by the normal wash as in Example 1. The prints showed equal color intensity although 20% less dye was used in the example.

EXAMPLE 3

Preparation of 3% Calcium/Sodium Alginate

The calcium/sodium alginate used in Examples 1 and 2 was prepared as follows.

Alginic acid which if fully converted to sodium alginate would give a 1.0% solution viscosity of 600–800 cP, 20° C., RVT/RVF Brookfield, 20 rpm, spindle 3, was used. The dry solids content of the alginic acid was 35 per cent. Sufficient dry calcium carbonate was added to contribute approximately 3 per cent calcium ion based on the dry weight of alginic acid. The mixing was carried out in a Z blade mixer at ambient temperature to allow the reaction to proceed to completion. Dry sodium carbonate was then added sequentially until a 0.5% solution of mixed salt gave a pH of 5.5–7.5. The wet mix of the calcium sodium alginate was then discharged, dried, and milled.

What is claimed is:

1. A print paste composition comprising (1) a pigment, anionic dye, or non-ionic dye, and (2) 1 to 5% (wt. mixed salt/wt. print paste composition) of a calcium/sodium alginate mixed salt wherein the calcium in said mixed salt ranges from 1.6 to 6% (wt. $Ca^{++}$/wt. Na alginate).

2. A print paste composition of claim 1 wherein the mixed salt ranges from 1 to 2.5%.

3. A print paste composition of claim 1 wherein the calcium in the mixed salt ranges from 2.5 to 5%.

4. A print paste composition of claim 1 further comprising a thickening agent which is one or a combination of guar, locust bean gum, carboxymethyl cellulose, and sodiumcarboxymethyl cellulose.

5. A process for printing substrates which comprises applying to said substrates a print paste composition comprising (1) a pigment, anionic dye, or non-ionic dye, and (2) 1 to 5% (wt. mixed salt/wt. print paste composition) of a calcium/sodium alginate mixed salt wherein the calcium in said mixed salt ranges from 1.6 to 6% (wt. $Ca^{++}$/wt. Na alginate).

6. A process of claim 5 wherein the mixed salt ranges from 1 to 2.5%.

7. A process of claim 5 wherein the calcium in the mixed salt ranges from 2.5 to 5%.

* * * * *